United States Patent [19]

Myers

[11] Patent Number: 4,844,120

[45] Date of Patent: Jul. 4, 1989

[54] MOTORIZED CONTROL DAMPER

[76] Inventor: Melvin J. Myers, 151 Harborage Ct., Clearwater, Fla. 34630

[21] Appl. No.: 187,058

[22] Filed: Apr. 27, 1988

[51] Int. Cl.[4] ..... F24F 13/08

[52] U.S. Cl. ..... 137/601; 251/129.11; 251/129.02; 251/212; 98/121.2

[58] Field of Search ..... 251/212, 129.02, 129.11; 137/601; 98/121.2

[56] References Cited

U.S. PATENT DOCUMENTS 3,042,357 7/1962 Engholdt ..... 251/129.11 X 3,319,646 5/1967 Smulka ..... 251/129.11 X 3,464,341 9/1969 Dobrin ..... 98/121.2 X 3,996,952 12/1976 Root ..... 137/601 X

*Primary Examiner*—Arnold Rosenthal

*Attorney, Agent, or Firm*—Dominik, Stein, Saccocio, Reese, Colitz & Van Der Wall

[57] ABSTRACT

A motorized control damper having at least one damper blade mounted to a drive journaled within a framework. An electric motor is directly connected to one end of the drive shaft on one side of the framework and a return spring connected to the other end of the drive shaft, preferably concentrically. Operation of the electric motor opens the damper blade by rotation of the drive shaft. Upon de-energization of the electric motor, the return spring counter rotates the drive shaft to close the damper blade.

3 Claims, 1 Drawing Sheet

MOTORIZED CONTROL DAMPER

BACKGROUND OF THE INVENTION

1. Field of the Invention

This invention relates to control dampers for heating, ventilation and air conditioning systems. More particularly, this invention relates to motorized control dampers having one or more damper blades movable between opened and closed positions.

2. Description of the Background Art

Heating, ventilating and air conditioning (HVAC) systems are typically zoned to direct the air flow to selected portions of a building. More particularly, zoned HVAC Systems typically utilize control dampers positioned in the duct work to selectively allow or prevent air flow through the duct to the zone of the building being served by such duct. The use of such control dampers allow one HVAC systems to selectively heat or cool the various zones of the building thereby eliminating the need for separate HVAC systems.

Control dampers usually comprise a substantially rectangular frame work having one or more damper blades positioned from side to side. Either a manual crank or a motor is operatively connected to one of the damper blades so as to move the blade between an obstructing, closed position and a substantially non-obstructing, opened position. Mechanical linkages are typically provided to also mechanically operates the other damper blades simultaneous with the damper blade being driven by the crank or motor.

In many applications, it is desired for motorized control dampers to be either normally opened or normally closed. Typically, the motor operatively connected to the driven damper blade functions to drive the blade from its normally closed or open position to the other position. Then, upon the deenergizing of the motor, the damper blades return to their normal position by means of a return spring mounted within or approximate to the motor.

Therefore, it is an object of this invention to provide an apparatus which overcomes the aforementioned inadequacies of the prior art devices and provides an improvement which is a significant contribution to the advancement of the motorized control damper art.

Another object of this invention is to provide a motorized control damper having an improved return spring which functions to return the damper blades to their normal position, either closed or opened.

Another object of this invention is to provide a motorized control damper having an improved return spring so positioned relative to the damper blade being driven that such blade is promptly returned to its normal position, either opened or closed.

Another object of this invention is to provide a motorized control damper having a return spring which is positioned concentrically relative to the drive shaft of the damper blade being driven so as to exert adequate force on the drive shaft to return the damper blade being driven, and in the other damper blades mechanically linked thereto, to their normally opened or closed positions.

Another object of this invention is to provide a motorized control damper having a return spring mounted concentrically with the drive shaft of the damper blade being driven on the side of the damper opposite that to the motor such that the output shaft of the motor can be directly connected to the drive shaft at one side of the damper and the return spring connected to the other end of the drive shaft on the other side of the damper allowing the control damper to be easily mounted within an existing duct.

The forgoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purposes of summarizing the invention, the invention comprises a motorized control damper having one or more damper blades pivotedly connected within a housing, one damper blade of which is operatively driven by an electric motor from its normal position, either closed or opened, to the other position, either opened or closed, respectively.

More particularly, the motorized control damper or the invention includes a drive shaft positioned along the longitudinal axis of the damper blade being driven and extending through the side members of the damper by means of journal bearings. The output shaft of the electric motor is directly connected to one end of the drive shaft extending from the side frame. A return spring is directly connected, preferably concentrically, to the other end of the drive shaft extending from the other side of the frame of the control damper. Thus, the damper blade is driven directly by the electric motor to move it, and the other damper blades, from their normal position, either opened or closed, to their other position. The return spring is also directly connected to the drive shaft such that the damper blade being driven, along with the other damper blades, are quickly and forceably return to their normal position when the electric motor is de-energized.

The direct drive of the electric motor and the direct connection of the return spring to the drive shaft eliminates substantially all of the drive linkages commonly found in the prior art control dampers. Furthermore, the direct connection of the return spring to the drive shaft assures that adequate force will be exerted to return the damper blades to their normal position, particularly when such normal position is a normally closed position whereupon the damper blades must be closed against the force of the air flow flowing through the duct. Finally, the direct connection of the electric motor and the return spring allows the control damper to be quickly and easily inserted into an existing duct by simply cutting a slot in the duct equal to the thickness of the control damper allowing the control damper to be slid into the slot in tranverse position in the duct and secured into place.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
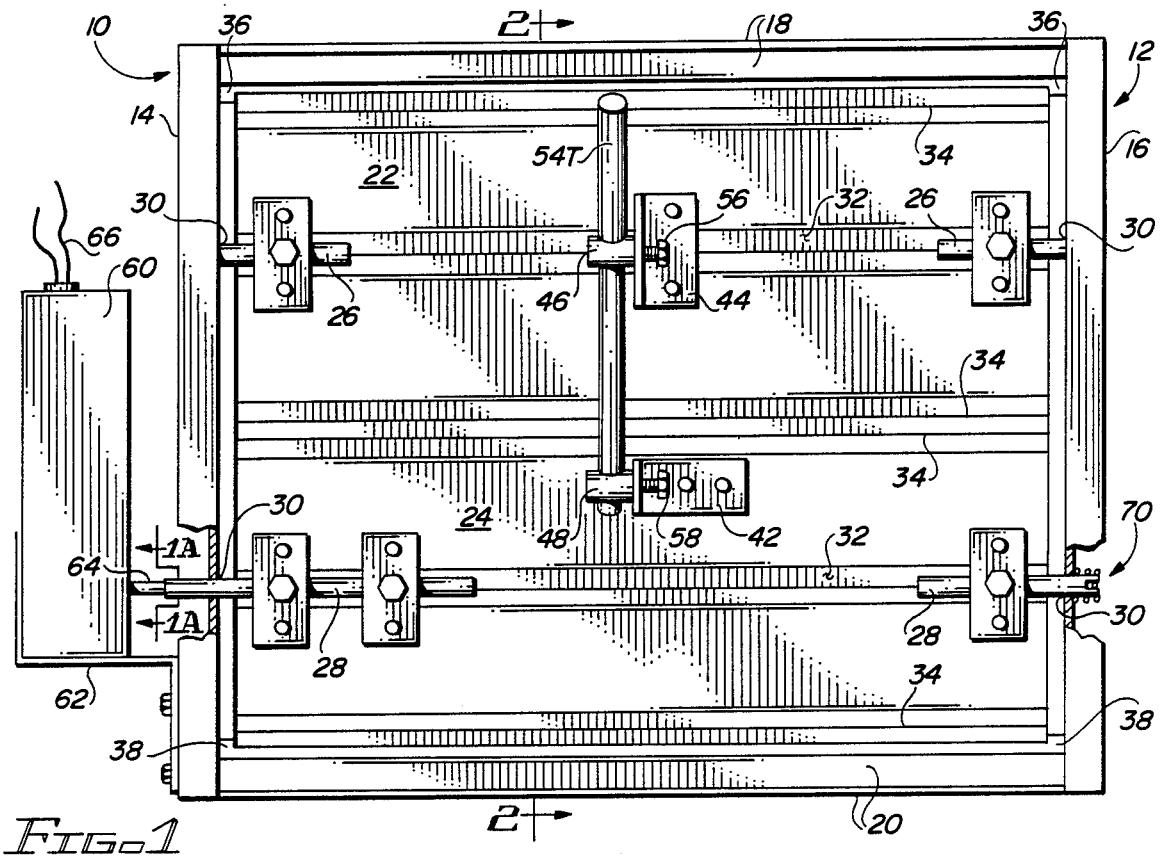
FIG. 1 is a front view of the motorized control damper of the invention illustrating two damper blades operatively connected together, the lower one of which is directly driven by an electric motor to move from a normally closed position to an opened position.

Referring to FIG. 1, the motorized control damper 10 of the invention comprises a generally rectangular framewood 12 including left and right side members 14 and 16 positioned in a spaced-apart manner by means of upper and lower members 18 and 20 to define a generally rectangular opening. A pair of upper and lower damper blades 22 and 24 are positioned across the opening of upper and lower longitudinal shafts 26 and 28 by mean of brackets 29 and journaled to the respective side members 14 and 16 by means of journal bearings 30.

Figure 2:
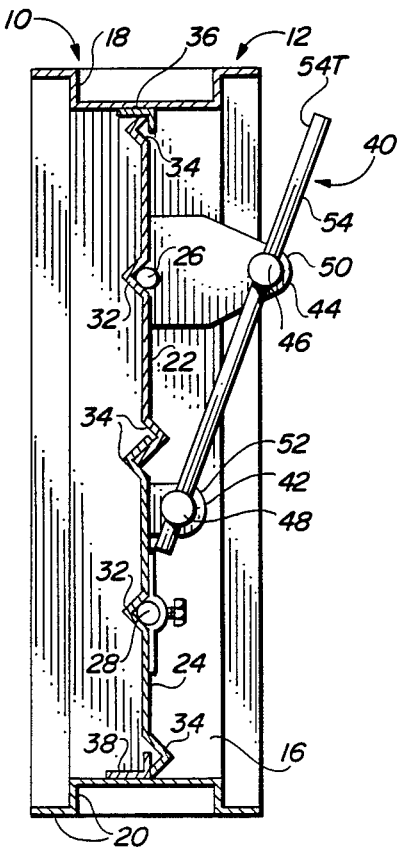
FIG. 2 is a cross-sectional view of FIG. 1 along lines 2—2 illustrating the cross-sectional configuration of the damper blades and the manner in which the damper blades are operatively connected together to simultaneously open or close.

As shown in FIG. 2, each of the damper blades 22 and 24 includes a raised center portion 32 and raised edge portions 34 positioned longitudinally along the length thereof. The shafts 26 and 28 are preferably positioned within the raised center portion 32 such that the longitudinal axis of the shafts 26 and 28 are coplanar with the damper blades 22 and 24. The raised edge portions 34, positioned in reversed order as shown in FIG. 2, function to provide an adequate air seal between the damper blades 22 and 24 and between upper and lower flanges 36 and 38 extending inwardly from the upper and lower member 18 and 20, respectively. Without departing from the spirit and scope of the invention, the upper and lower shafts 26 and 28 may each comprise two stub shafts as shown in FIG. 1 extending from the sides of the damper blades 22 and 24 for rotatable engagement with the journal bearing 30. Also, without departing from the spirit and scope of this invention, the damper blades 20 and 22 may comprise other cross sectional configurations not including the raised center and edge portions 32 and 34.

The damper blades 22 and 24 are operatively connected together by means of linkage 40 such that movement of one damper blade from its vertical, closed position as shown in FIG. 2 to a substantially horizontal, opened position causes the other damper blade to likewise move from a vertical, closed position to a substantially horizontal, opened position. More specifically, linkage 40 comprises a lower bracket 42 rigidly mounted to the lower damper blade 24 adjacent to its upper edge portion 34 and a taller upper bracket 44 rigidly mounted to the upper damper blade 22, preferably to straddle the raised center portion 32 thereof. A pair of bosses 46 and 48 are rotatably mounted to the ends 50 and 52 of the respective brackets 42 and 44. A rod 54 extends through holes in the bosses 46 and 48 and rigidly secured into place by respective set screws 56 and 58. It is noted that such screws 56 and 58 allow adjustment of the rod 54 relative to the bosses 46 and 48 such that the rod 54 may be properly aligned when the closed position as shown in FIG. 2.

Movement of either damper blade 22 or 24 from the vertical position of FIG. 2 causes the other damper blade to simultaneously rotate in a counter direction to the horizontal, opened position. It is noted that the tip 54T of the rod 54 bears against the upper damper blade 22 when the blades 22 and 24 are in their horizontal position thereby functioning as a stop.

Figure 1A:
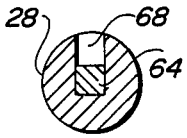
FIG. 1A is an enlarged cross-sectional view of FIG. 1 along lines 1A—1A illustrating the direct connection of the output shaft of the electric motor to the drive shaft of the damper blade being driven.

Referring again to FIG. 1 and also FIG. 1A, an electric motor 60 is rigidly secured relative to the framework 12 by means of bracket 62. The electric motor 60 comprises an output shaft 64 which rotates upon being energized via electrical wires 66.

Preferably, the output shaft 64 of the electric motor 60 is directly connected to one of the shafts 26 or 28, such as the lower shaft 28, to allow the electric motor 60 to rotatably drive the lower shaft 28 thereby rotating the lower damper blade 24 between its opened and closed positions. As shown in FIG. 1A, preferably the output shaft 64 of the electric motor 60 includes a non-round configuration such as a square, which keys into a corresponding slot 68 formed in the end of the lower shaft 28 extending from its journal bearing 30. Thus, it is readily seen that rotation of the output shaft 64 causes rotation of the lower shaft 28 without slippage. It is, however, within the scope of this invention to utilize other types of direct connections such as similar keyways, locking collars, or the like.

Figure 3:
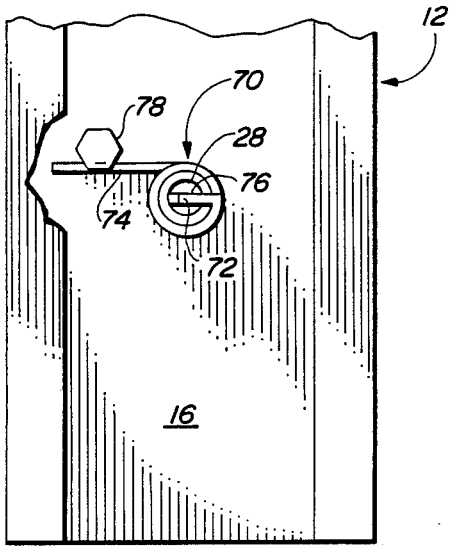
FIG. 3 is an enlarged, partial right side view of FIG. 1 illustrating the return spring of the motorized control damper of the invention being connected directly and concentrically to the drive shaft of the lower damper blade being driven by the electric motor.

As shown in FIG. 3, the motorized control damper 10 of the invention further includes a return spring 70 to return the damper blades 22 and 24 to their "normal" position when the electric motor 60 is not energized. Return spring 70 preferrably comprises a generally cylindrical design having an inside diameter appreciably greater than the outer diameter of the shaft to which it is to be connected, such as the lower shaft 28. One end 72 of the return spring 70 is preferably terminated across the diameter of the longitudinal opening of the spring 70 whereas the other end 74 is preferably terminated transversely in a position substantially tangently from the cylinder formed by the spring 70.

The return spring 70 of the invention as described above is adapted to be connected to the lower shaft 28 having a diametric slot 76 formed in its end extending from its journal bearing 30. Thus, the return spring 70 is adapted to be positioned concentrically about the end of the shaft 28 with the diametric end 76 being positioned within the diametric slot 76 of the shaft. Then, the tangentical end 74 of the spring 70 is moved circularly about the shaft 28 to force tension in the spring 70 and is then secured relative to the right side member 16 by means of stop screw 78 or other protrusion extending from the side member 16.

It shall be appreciated that the return spring 70 may be wound in one direction so as to force the damper blades 22 and 24 into a normally closed position as shown in the Figures, or wound in the opposite direction to force the damper blades 22 and 24 into a normally opened position.

During operation, the electric motor 60 is energized causing the damper blades 22 and 24 to rotate from their normally vertical, closed position to a horizontal, opened position. Upon the deenergizing of the electric motor 60, return spring 70 forces the damper blades 22 and 24 to return to their normally closed position as shown in FIG. 2.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described,

WHAT IS CLAIMED IS:

1. A motorized control damper, comprising in combination:

a framework defining an opening, said framework including a left side and a right side:

at least one damper blade to be positioned within said opening;

a drive shaft means nonrotatably connected to said damper blade, said drive shaft means having a first end rotatably extending through one side of said framework;

motor means including an output shaft;

means for operatively connecting said output shaft of said motor means to said damper blade to cause rotation of said damper blade between a closed position and an opened position;

a return spring configured for direct connection to said first end of said drive shaft means to move said damper blade to a normal position when said motor means is de-energized, said return spring comprising a generally cylindrical configuration design having an inner diameter appreciably greater than an outer diameter of said first end of said drive shaft means and having a first end positioned substantially transverse to said cylindrical configuration and a second end positioned substantially tangently relative to said cylindrical configuration;

said first end of said drive shaft means comprising an aperature for receiving said first end of said return spring;

said side of said framework including a protuberence for securing said second end of said return spring, whereby said return spring exerts a rotatable force to said drive shaft means;

said drive shaft means including a second end rotatably extending through the other side of said framework; and said means for operatively connecting said output shaft of said motor means to said damper blade comprising means for directly connecting said output shaft of said motor to said second end of said drive shaft.

2. The motorized control damper as set forth in claim 1, wherein said means for directly connecting said output shaft of said motor means to said second end of said drive shaft means comprises said output shaft having a nonround cross-sectional configuration which mates into a nonround aperature means positioned in said second end of said drive shaft means.

3. The motorized control damper as set forth in claim 2, wherein said nonround output shaft of said motor means comprises a substantial rectangular configuration and wherein said aperature means of said second end of said drive shaft means comprises a substantially rectangular slot.

* * * * *